US006299136B1

(12) United States Patent
Nakayama

(10) Patent No.: US 6,299,136 B1
(45) Date of Patent: Oct. 9, 2001

(54) HIGH BROW CLAW HAMMER HEAD

(76) Inventor: Toshiro Nakayama, 2 Saddlehorn La., Rolling Hills Estates, CA (US) 90274

( * ) Notice: Subject to any disclaimer, the term of this patent is extended or adjusted under 35 U.S.C. 154(b) by 0 days.

(21) Appl. No.: 09/313,569

(22) Filed: May 3, 1999

Related U.S. Application Data

(60) Provisional application No. 60/086,181, filed on May 20, 1998.

(51) Int. Cl.[7] ..... B25C 11/00

(52) U.S. Cl. ..... 254/26 R; 81/20; 81/26

(58) Field of Search ..... 81/20, 22, 23, 81/26; 254/21, 25, 26 R

(56) References Cited

U.S. PATENT DOCUMENTS

| | | | | |
|---|---|---|---|---|
| D. 32,402 | | 3/1900 | Whitford | 254/26 R |
| D. 35,290 | | 11/1901 | MacDermott | 81/20 |
| D. 140,821 | | 4/1945 | MacWithey | 254/26 R |
| 603,228 | | 4/1898 | Ashley | 254/26 R |
| 619,608 | | 2/1899 | Penny | 81/20 |
| 638,341 | | 12/1899 | Knight | 81/26 |
| 834,827 | | 10/1906 | Luse | 81/26 |
| 1,042,177 | | 10/1912 | Vredenburg | 254/26 R |
| 1,159,583 | | 11/1915 | Haight | 81/20 |
| 1,201,171 | | 10/1916 | Grant | 254/26 R |
| 1,934,706 | | 11/1933 | Green | 81/23 |
| 1,957,760 | | 5/1934 | Cownie | 254/26 R |
| 2,420,120 | | 5/1947 | Bruchsaler | 81/20 |
| 3,578,825 | * | 5/1971 | Merrow | 81/20 |
| 4,193,433 | | 3/1980 | Sickler | 81/23 |
| 4,290,583 | | 9/1981 | Lombardi | 81/20 |
| 4,718,313 | | 1/1988 | Yamaguchi | 81/23 |
| 5,159,858 | | 11/1992 | Gansen | 81/20 |
| 5,280,738 | * | 1/1994 | Liou | 81/20 |

* cited by examiner

*Primary Examiner*—Eileen P. Morgan
*Assistant Examiner*—Joni B. Danganan

(57) ABSTRACT

A claw hammer head having a body, a neck extending from the front of the body and having a face, and a claw extending from the back of the body. The claw is a multi-radius claw having a profile which maximizes hand-pull leverage during the entire scope of a nail pull rotation. The head has a high raised brow. The claw tips are tapered and pointed, enabling the claw to dig under nail heads that are below the wood surface. The claw has a very sharp V slot near the end of the claw. The head is provided with a cup in the pocket which is used to hold a nail head when one handed spiking with a nail positioned with the head of the nail in the cup and a shank in the slot captured by the V shape of the slot. The neck is a long reach neck with a progressive radius and the face is oversized and slightly contoured to about equal to a 6" R. The edge of the face is chamfered. The head is provided with large side hitting faces on each side of the body.

15 Claims, 2 Drawing Sheets

HIGH BROW CLAW HAMMER HEAD

This application claims the benefit of U.S. Provisional Application No. 60/086,181, filed May 20, 1998.

BACKGROUND OF THE INVENTION

The present invention relates to a claw hammer head and, more specifically, an improved claw hammer head having a high brow and multi-radiused claw with tapered, pointed claw tips and a very sharp V slot.

In order to keep the terminology that is used in this patent clear, the following definitions are used throughout the specification and claims:

Head: The object attached to the end of the handle, used to strike the nail.

Face: The surface of the "head" traditionally used to strike the nail.

Body: The main portion of metal on which the rest of the hammer is formed.

Neck: The part of the head between the face and the body.

Socket: The longitudinal hole in the body material in which the end of the handle is inserted and fixed in the usual manner by one or more wedges.

Side-hitter: A "face" on the side of the body used for hitting nails in tight places.

Claw: The part of the head used to remove a nail from wood.

Slot: The area in the claw in which the shank of the nail is gripped to remove the nail from the wood.

Rocker: The longitudinal curvature of the surface of the claw that bears against the wood.

Roll: The lateral curvature of the surface of the claw that bears against the wood.

Brow: The top of the body including the socket adjoining the rocker.

Pocket: The pocket is the area of the head between the interior surface of the claw and rear face of the body of the head.

Cup: The cup is a small indentation on the rear surface of the body at a position roughly in line with a initial opening of the slot or throat adjacent the tips of the claw.

Spiking: The act of starting a nail in the wood, using only the hammer head to hold the nail.

Claw hammer heads have been long known in the art. Generally, the heads have a low brow with a uniform radius curved claw on one side and a short neck with flat face on the other side. These conventional hammer heads, with a low brow (from top to top edge of face being on the order of ¼ to 5⁄16") is designed to pull 1½" nails. Additionally, with conventional hammer heads having a low brow, at close to limit of travel during nail pull rotation, the top edge of the face can and often does contact the wood, (dents and dings) which is especially undesirable if doing finishing work in expensive hard woods. The claw generally has square end, blunt, chisel-like tips and a relatively broad V slot for pulling nails. The neck of a conventional hammer head is only about 1¾". The face is flat and parallel with the centerline of the handle of the hammer.

SUMMARY AND OBJECTS OF THE INVENTION

It is an object of the present invention to provide a claw hammer especially suitable for easily pulling long nails with much less pulling power.

It is another object of the present invention to provide a claw hammer better adapted for pulling small head finishing nails and even "headless" nails.

It is yet another object of the present invention to provide a claw hammer with the ability to remove embedded nails with the specially designed claw.

It is yet a further object of the present invention to provide a claw hammer better adapted for spiking.

The high-brow head combined with a progressive radius claw curve reduces the force needed to only a few pounds over the entire arc of nail pulling rotation. The claw tips are pointed, enabling the claw to dig under nail heads that are below the wood surface. The claw has a very sharp V throat which can dig right into the shank of the nail, for pulling out a nail with an additional leverage or for spiking. The wedging effect in the slot keeps the nail from moving sideways while the contoured cup holds the head of the nail securely to prevent turning of the nail about the pivot at the slot.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF A PREFERRED EMBODIMENT

Figure 3:
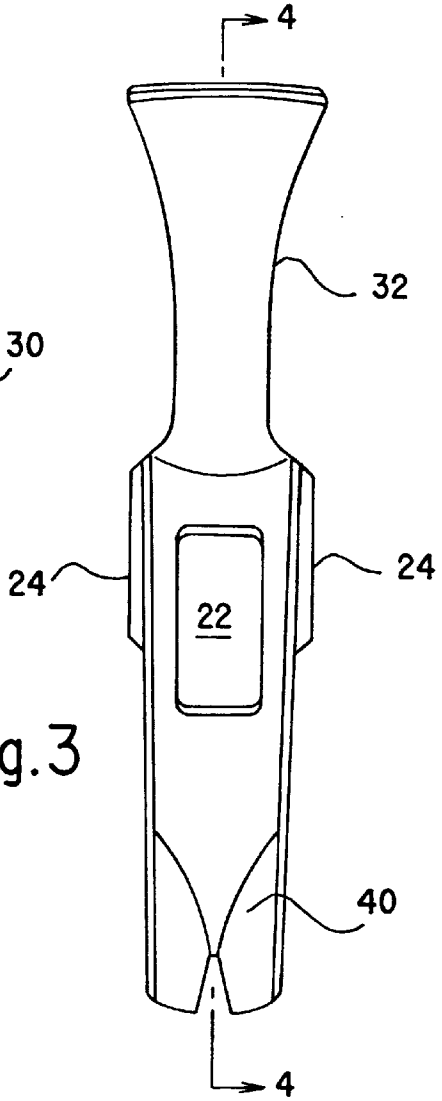
FIG. 3 is a top view of the present invention.
Figure 1:
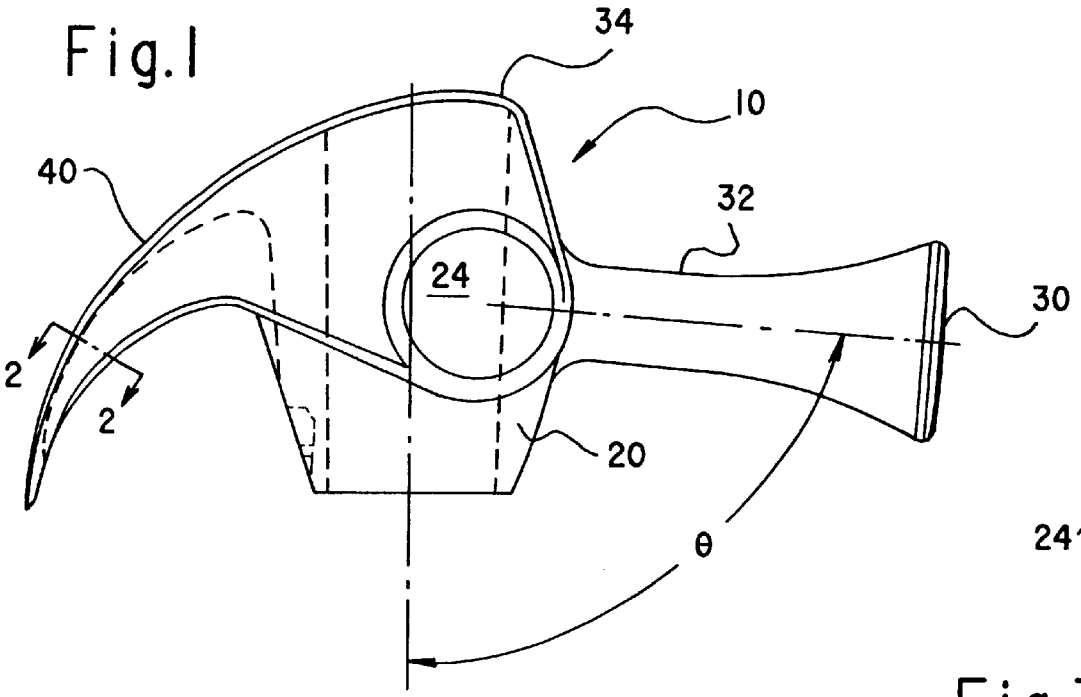
FIG. 1 is a side view of the present invention.
Figure 2:
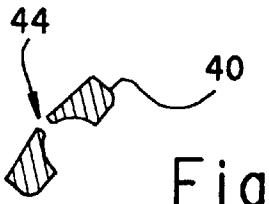
FIG. 2 is a cross-sectional view taken along line 2—2 in FIG. 1.
Figure 5:
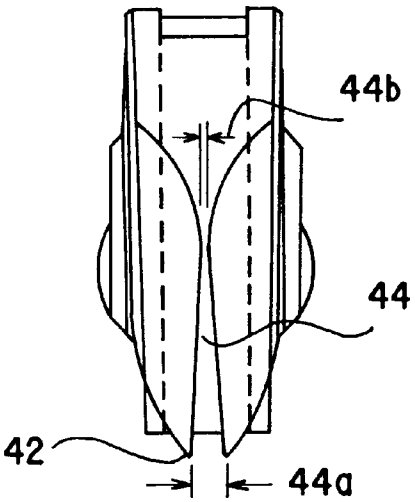
FIG. 5 is a rear view of the present invention.
Figure 4:
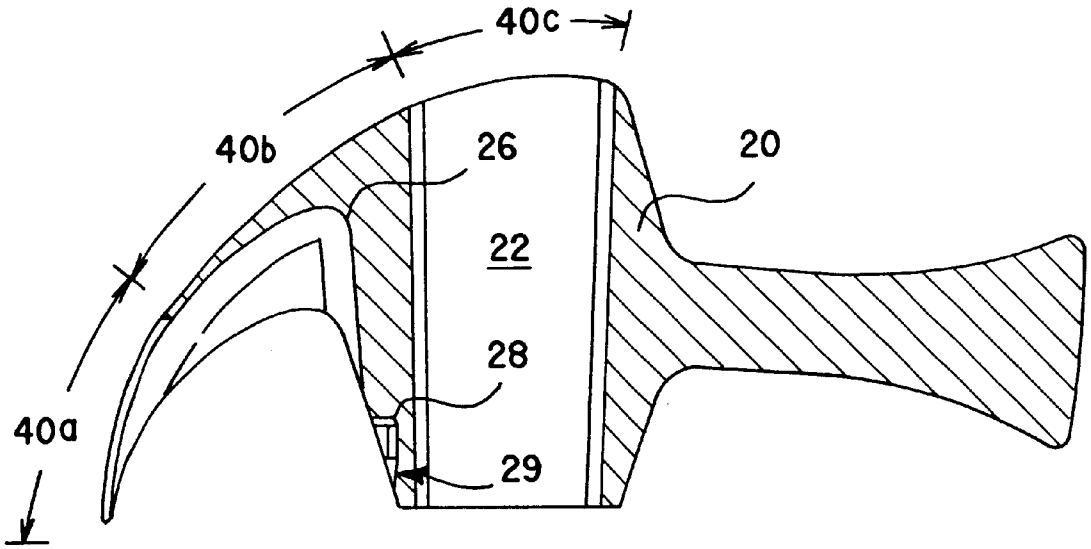
FIG. 4 is a cross-sectional view taken along line 4—4 in FIG. 3.

The present invention is a claw hammer head 10 having a body 20, a neck 32 extending from the front of the body 20 and having a face 30, and a claw 40 extending from the back of the body 10. The head 10 is made, for example, of alloy steel and has the conventional socket 22 for mounting the head 10 on a wood or fiberglass handle (not shown) in the conventional manner using wedges or epoxy.

The head 10 has a high raised brow 34. The high brow 34, combined with a progressive radius claw rocker or curve (discussed below), easily pulls the full length of a 3.5"× 0.162", 16D common nail before contact is made with the top of the hammer face 30. The distance between top of brow 34 and top surface (edge) of the neck 32 is about ⅞". This high brow 34 ensures a flat and stable fulcrum surface as the claw 40 is rotated through the critical portion of its 93 degrees of travel during nail pull rotation. This high brow 34 also allows additional # degrees of travel of the head 10 during nail pull rotation. This also eliminated an unstable "pivot" pull (pivoting in the hammer face), as is typical with all other hammer models commercially available.

The multi-radius claw 40 has a profile which maximizes hand-pull leverage during the entire scope of a nail pull rotation. The first rocker portion 40*a* (to begin the nail pull rotation) at the end of the claw near the tips 42 has a small radius, for example, 2.0" R. This creates a large leverage ratio, allowing for easy initial extraction of the nail (only a few pounds of push needed by user). The radius changes at the second rocker portion 40*b* in middle portion of the claw 40 to a larger radius, for example, 3.75" R. The third rocker portion 40*c* has a finish radius at and adjacent the brow which returns to a smaller radius, for example, 2.00" R. The substantially flat outer surface (roll of a 2.00" R) (across the width) of the claw 40 gives added stability during the rotation of the claw 40.

The claw tips 42 are tapered and pointed, enabling the claw 40 to dig under nail heads that are below the wood surface. With claw tips 42 positioned at the sides of the nail to be pulled, hitting the face 30 of the head 10 with another hammer drives the claw tips 42 into the wood until the edges of the slot 44 bite into the shank of the nail. The present inventive hammer head 10 is also designed to pull nails without a head. The claw 40 has a very sharp V slot 44 (for example, a width 44*a* adjacent the tips of 0.22", a width 44*b* at top of wedge slot of 0.05", a length of the slot of 1.28") which can dig right into the shank of the nail, pulling out the nail with an additional leverage. This even enables pulling of deep set finishing nails or "headless" nails. Most conventional hammers have square end, blunt, chisel-like tips and a relatively broad V slot.

The head 10 is provided with a cup 28 in the pocket 26 which is used to hold the nail head when one handed spiking with the nail positioned with the head of the nail in the cup 28 and the shank in the slot 44 captured by the V shape of the slot 44. The wedging effect in the slot 44 keeps the nail from moving sideways while the contoured cup 28 holds the head of the nail securely to prevent turning of the nail about the pivot at the slot 44. The contoured cup surface 29 is slightly curved such that the nail is held securely without wobble yet when the nail strikes its surface (to be nailed during a one hand spike), the nail disengages from the cup 28 and is freed from the claw 40 (dislodged by shock). Then in typical fashion, the nail is pounded in using the hammer face 30. The inside of pocket 26 on claw side can be hollowed, with flanges on claw 40 extending inwardly toward body 20.

The present invention has a long reach neck 32 (for example, 2.35") which is designed to reach over a 2×4 stud, to an obscured nail on the far side of the 2×4 stud. This hammer head design has an overstrike capability of 2 inches. A neck of a conventional hammer head is 1¾" or less.

The progressive radius neck 32 (shaped like a trumpet) dampens and distributes impact forces to minimize impact shock to the users hand, wrist and elbow. Initial face 30 diameter can be 1.25" with the neck diameter adjacent joining of body being 0.60". The progressive flare portion of the neck 32 has radius adjacent the face 30 of 3.5" R merging with cylindrical portion to the body 20. This allows for the full weight force to be focussed at the entire surface of the hammer head where the head strikes the target (even if nail is hit close to face edge, the same force is provided.) The force goes to edges of face. The neck is angled at $\theta$=86 degrees measured downwardly relative to the centerline of the hammer handle, forming an acute angle (less than 90 degrees). This acute angle ensures that the hammer face strikes the nail head with a positive hooking action, making a more efficient strike (force used/nail penetration). The angle of the head surface (where it hits the nail) and end of hammer provides a natural accommodation to the wrist of the user and maximizes the depth of the hit which results in the nail being driven deeper and faster for each strike.

The oversized hammer face 30 (25% larger than conventional) gives a larger sweet spot for more accurate and efficient nail striking. The face 30 is slightly contoured to about equal to a 6" R. This causes the force to follow the contour which maximizes efficient area of hitting. The edge of the face 30 is chamfered. The particular design gives additional driving force, due in part to longer contact.

The large side hitting faces 24 on each side of the body 20 of the head 10 allows hammer accessibility to tight areas. The side hitter 24 is located almost at the CG of the hammer's head, eliminating unwanted side torque. This feature is used in tight places, for example, between studs when installing electrical boxes.

It is readily apparent that the abovedescribed has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A claw hammer head, comprising:

a body disposed along and about a horizontal axis, a vertical axis and a transverse axis which intersect one another perpendicularly at a point of intersection;

a neck connected to and extending forwardly of the body generally along and about the horizontal axis, the neck terminating in a face portion sized and adapted to impact a target; and a claw having a high brow portion disposed generally vertically apart from an intersection of the horizontal and transverse axes and a claw portion positioned generally rearwardly of the body and integrally formed with the high brow portion to define a fulcrum surface curving about the point of intersection, the fulcrum surface having a first rocker portion with a first radius, a second rocker portion with a second radius and a third rocker portion with a third radius, the second rocker portion being disposed between the first and third rocker portions with the second radius being larger than the first and third radii.

2. A claw hammer head according to claim 1, wherein the second radius is approximately 1.875 times larger than at least one of the first and third radii.

3. A claw hammer head according to claim 2, wherein the first and third radii are approximately equal to one another.

4. A claw hammer head according to claim 1, wherein the first and third radii are approximately two inches and the second radius is approximately three and three quarter inches.

5. A claw hammer head according to claim 1, further comprising at least one side hitting face formed on and projecting from the body.

6. A claw hammer head according to claim 1, further comprising a cup formed into the body and facing the claw portion, the cup having a cup surface defining a contoured cavity sized to receive a nail head as the nail head moves in a horizontal direction away from the claw portion.

7. A claw hammer head according to claim 1, wherein the claw portion has a centrally disposed V-shaped slot forming a pair of claw arms, each one of the pair of claw arms having a free end tapering towards the V-shaped slot and terminating at a sharp point, the sharp points of the pair of claw arms defining an opening Into the V-shaped slot.

8. A claw hammer head according to claim 7, wherein the V-shaped slot extends along the first rocker portion.

9. A claw hammer head according to claim 1 wherein the neck is trumpet-shaped with a narrow end, the narrow end of the neck being connected to the body.

10. A claw hammer head, comprising:

a body disposed along and about a horizontal axis, a vertical axis and a transverse axis which intersect one another perpendicularly at a point of intersection;

a neck connected to and extending forwardly of the body generally along and about the horizontal axis, the neck terminating in a face portion sized and adapted to impact a target;

a claw having a high brow portion disposed generally vertically apart from an intersection of the horizontal and transverse axes and a claw portion positioned generally rearwardly of the body and integrally formed with the high brow portion to define a fulcrum surface curving about the point of intersection, the fulcrum surface having a first rocker portion with a first radius, a second rocker portion with a second radius and a third rocker portion with a third radius, the second rocker portion being disposed between the first and third rocker portions with the second radius being approximately 1.875 times larger than at least one of the first and third radii;

at least one side hitter formed on and projecting from the body; and a cup formed into the body and facing the claw portion, the cup having a cup surface defining a contoured cavity sized to receive a nail head as the nail head moves rectilinearly along the horizontal axis away from the claw portion.

11. A claw hammer head according to claim 10, wherein the first and third radii are approximately equal to one another.

12. A claw hammer head according to claim 11, wherein the first and third radii are approximately two inches and the second radius is approximately three and three quarters inches.

13. A claw hammer head according to claim 10, wherein the claw portion has a centrally disposed V-shaped slot forming a pair of claw arms, each one of the pair of claw arms having a free end tapering towards the V-shaped slot and terminating at a sharp point, the sharp points of the pair of claw arms defining an opening into the V-shaped slot.

14. A claw hammer head according to claim 13, wherein the V-shaped slot extend along the first rocker portion.

15. A claw hammer head according to claim 10, wherein the neck is trumpet-shaped with a narrow end, the narrow end of the neck being connected to the body.

* * * * *